US006892046B2

(12) United States Patent
Fujita et al.

(10) Patent No.: US 6,892,046 B2
(45) Date of Patent: May 10, 2005

(54) IMAGE FORMING APPARATUS WITH EXPOSABLE SURFACE BETWEEN BODY AND PERIPHERAL APPARATUS

(75) Inventors: Masahiko Fujita, Nara (JP); Masaya Asakawa, Yamatokoriyama (JP); Toshiki Ohgita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/441,793

(22) Filed: May 20, 2003

(65) Prior Publication Data

US 2003/0219293 A1 Nov. 27, 2003

(30) Foreign Application Priority Data

May 21, 2002 (JP) ..... P2002-146503

(51) Int. Cl.[7] ..... G03G 15/00
(52) U.S. Cl. ..... 399/381; 399/401
(58) Field of Search ..... 399/381, 401, 399/402, 107

(56) References Cited

FOREIGN PATENT DOCUMENTS

JP 11-212307 8/1999

OTHER PUBLICATIONS

U.S. Appl. No. 10/335,611 filed Jan. 2, 2003 titled Image Forming System.

*Primary Examiner*—Quana Grainger
(74) *Attorney, Agent, or Firm*—Renner, Otto, Boisselle & Sklar, LLP

(57) ABSTRACT

An upper surface of a sheet feeding apparatus located below the switch back feeding path is opened. When a relay feeding apparatus is drawn out from the body apparatus, a supporting tray is also drawn out from a switch back feeding path and a lower surface of a switch back feeding path is opened into the sheet feeding apparatus between the supporting tray open end and a holding member and one end of a sheet discharged into the switch back feeding path hangs in the sheet feeding apparatus. An intermediate tray is pulled out on the front of the sheet feeding apparatus and the operator's fingers are inserted into a space in which the intermediate tray is mounted and the sheet discharged into the switch back feeding path is grasped and drawn out on the front of the sheet feeding apparatus and collected.

8 Claims, 6 Drawing Sheets

IMAGE FORMING APPARATUS WITH EXPOSABLE SURFACE BETWEEN BODY AND PERIPHERAL APPARATUS

BACKGROUND OF THE INVENTION

1. Field of the Invention

The present invention relates to an image forming apparatus such as a copying machine, a printer, a facsimile machine or the like, capable of performing image formation on both main and back sides of a recording sheet such as a sheet or the like.

2. Description of the Related Art

Recently, there has been an increasing demand for an image forming apparatus which forms images on both main and back sides of a recording sheet for resource saving. In this kind of image forming apparatus, a recording sheet with an image formed on one side of the recording sheet is fed again to an image forming portion under condition where the recording sheet is reversed through a switch back mechanism or the like and fed again to an image forming portion, thereby there was an image forming apparatus provided with a switch back feeding path which is used as a switch back feeding space for reversal of leading and rear ends of the recording sheet in a feeding direction and is arranged on an internal portion of a body apparatus provided with the image forming portion or on an internal portion of a peripheral apparatus to be mounted on the body apparatus later or is arranged so as to utilize a space on the outside of a setting space for the image forming apparatus. Generally, the switch back mechanism comprises a pair of rollers arranged so as to be freely rotated forward and backward at an entrance of the switch back feeding path. The pair of rollers guides the recording sheet to the switch back feeding path by normal rotation of the rollers and reverses the leading and rear ends of the recording sheet in the feeding direction by reversing the recording sheet with a part of the recording sheet keeping held between the rollers.

However, when the body apparatus or the peripheral apparatus is provided with the switch back feeding path, the configuration of the body apparatus or the peripheral apparatus becomes complicated and thereby the enlargement of the size of the body apparatus or the peripheral apparatus and increase of the related cost are caused. In addition, when the space on the outside of the location space for the image forming apparatus is utilized as the switch back feeding path, enough space should be secured in a position close to the image forming apparatus to prevent damage of the recording sheet to be switched back and fed from arising by the recording sheet's touching goods on the outside and therefore utilization of a space close to the setting position of the image forming apparatus is restricted and as a result a large setting space should be required. When this switch back feeding path is arranged on the outside of the discharging portion of the image forming apparatus, only a special post-processing apparatus provided with the mechanism which lets the recording sheet switch back and feed can be used as a post-processing apparatus to be mounted on the discharging portion later.

The applicant suggested the configuration including the switch back feeding path arranged for reversing the recording sheet in a gap formed between the body apparatus and the peripheral apparatus. By using this configuration, there is no need for the switch back feeding path on both any internal portions of the body apparatus and the peripheral apparatus and any position on the outside of the setting space for the image forming apparatus and this no need for the switch back feeding path can prevent enlargement of the size of the body apparatus or the peripheral apparatus and increase of the related cost caused by complication of the configuration of the body apparatus or the peripheral apparatus and also can prevent enlargement of the size of the setting space for the image forming apparatus and specialization of the post-processing apparatus.

However, when the body apparatus or the peripheral apparatus is brought to emergency stop and the power source is shut down because of malfunction of the control system or a recording sheet feeding jam caused by any trouble, braking force cannot be operated for the pair of rollers configuring the switch back mechanism and the pair of rollers continues to rotate under inertia force of the rollers before emergency stop of the body apparatus or the peripheral apparatus. Therefore, when the emergency stop of the body apparatus or the peripheral apparatus occurs in the middle of feeding the recording sheet under condition prior to reversing the leading and rear ends of the recording sheet in the feeding direction into the switch back feeding path by the pair of rollers rotating normally, there is a possibility that the recording sheet will continue to be moved in the feeding direction by the pair of rollers continuing to rotate normally under the inertia force of the rollers and the recording sheet will be discharged into the switch back feeding path and will not be held between the pair of rollers.

When the recording sheet is discharged into the switch back feeding path between the body apparatus and the peripheral apparatus and is not held between the pair of rollers as mentioned above, the recording sheet cannot be fed to the outside of the body apparatus and the peripheral apparatus by reverse rotation of the pair of rollers, but in the case of configuration forming the switch back feeding path in a narrow gap between the body apparatus and the peripheral apparatus, an operator's fingers cannot be put in the switch back feeding path from the outside of the body apparatus and the peripheral apparatus. Therefore, there is a problem that the recording sheet fed into the switch back feeding path cannot be removed by separating the body apparatus from the peripheral apparatus and recovery work to be performed after the emergency stop becomes complicated.

SUMMARY OF THE INVENTION

The object of the invention is to provide the image forming apparatus which enables the recording sheet fed into the switch back feeding path arranged in the gap between the body apparatus and the peripheral apparatus to be easily removed and enables enlargement of the size of the body apparatus or the peripheral apparatus and increase of the related cost caused by complication of the configuration of the body apparatus or the peripheral apparatus to be prevented and also enables enlargement of the size of the setting space for the image forming apparatus and specialization of the post-processing apparatus to be prevented.

The invention provides the following configuration as means to solve the above-mentioned problems.

The invention provides an image forming apparatus comprising:

a body apparatus for performing an image forming processing for a recording sheet; and a peripheral apparatus to be mounted at least on a position above or below the body apparatus, a gap being formed as a switch back feeding path between the body apparatus and the peripheral apparatus, leading and rear ends of the recording sheet in a feeding direction being reversed in the switch back feeding path, wherein an upper surface of the body apparatus or the peripheral apparatus located on a lower position is opened.

In the invention, it is preferable that the peripheral apparatus to be mounted on a position above or below the body apparatus includes a housing, and that an opening through which an outside of the housing is communicated with an inside of the housing and in which the recording sheet can be freely inserted, is formed in an area of the housing facing the body apparatus.

According to the invention, the upper surface of the apparatus located below the switch back feeding path is opened. Consequently, the recording sheet discharged into the switch back feeding path because of emergency stop or the like of the body apparatus or the peripheral apparatus drops into internal portion of the apparatus located below the switch back feeding path from the opened upper surface of the apparatus and is removed from the switch back feeding path via the internal portion of the peripheral apparatus.

According to the invention, by opening the upper surface of the apparatus located below the switch back feeding path, the recording sheet discharged into the switch back feeding path can be made drop into the internal portion of the apparatus located below the switch back feeding path from the opened upper surface of the apparatus and can be removed from the switch back feeding path via the internal portion of the peripheral apparatus.

This enables the recording sheet discharged into the switch back feeding path arranged in the gap between the body apparatus and the peripheral apparatus to be removed and can prevent enlargement of the size of the body apparatus or the peripheral apparatus and increase of the related cost caused by complication of the configuration of the body apparatus or the peripheral apparatus and also can prevent enlargement of the size of the setting space for the image forming apparatus and specialization of the post-processing apparatus without making the recovery work troublesome after the emergency stop.

In the invention, it is preferable that the peripheral apparatus includes: a first peripheral apparatus mounted on a position above or below the body apparatus; and a second peripheral apparatus mounted on the body apparatus in the horizontal direction, having the switch back mechanism for reversing the leading and rear ends of the recording sheet in the feeding direction, and that the second peripheral apparatus is provided with a supporting tray extending into the switch back feeding path, for supporting the recording sheet, and the supporting tray is drawn out in the horizontal direction from the body apparatus with the second peripheral apparatus up to a position on which extension length of the supporting tray becomes shorter than the length in the feeding direction of the minimum recording sheet guided to the switch back feeding path.

According to the invention, when the second peripheral apparatus mounted on the body apparatus in the horizontal direction is drawn out from the body apparatus in the horizontal direction, the supporting tray extending into the switch back feeding path from the second peripheral apparatus is drawn out from the switch back feeding path and extension length of the supporting tray becomes shorter than the minimum length in the feeding direction of the recording sheet guided to the switch back feeding path. Consequently, the recording sheet discharged into the switch back feeding path by emergency stop or the like of the body apparatus or the peripheral apparatus certainly drops in the internal portion of the apparatus located below the switch back feeding path from the opened upper surface of the apparatus.

According to the invention, when the second peripheral apparatus mounted on the body apparatus in the horizontal direction is drawn out from the body apparatus in the horizontal direction, the supporting tray extending into the switch back feeding path from the second peripheral apparatus is drawn out from the switch back feeding path. The extension length of the supporting tray is made become shorter than the minimum length in the feeding direction of the recording sheet guided to the switch back feeding path and thereby the recording sheet discharged into the switch back feeding path by emergency stop or the like of the body apparatus or the peripheral apparatus can be certainly made drop in the internal portion of the apparatus located below the switch back feeding path from the opened upper surface of the apparatus.

In the invention, it is preferable that the peripheral apparatus mounted on a position above or below the body apparatus is arranged below the body apparatus and is a sheet feeding apparatus having a storage portion and a feeding path for the recording sheet to be supplied in the body apparatus.

According to the invention, the switch back feeding path is formed on the upper position of the opened upper surface of the sheet feeding apparatus having the storage portion and the feeding path for the recording sheet to be supplied in the body apparatus. Consequently, the recording sheet discharged into the switch back feeding path by emergency stop or the like of the body apparatus or the peripheral apparatus drops in the sheet feeding apparatus having configuration in which the internal portion of the sheet feeding apparatus is opened on the operation side because of need for storing work of the recording sheet in the storage portion and is taken out on the operation side of the sheet feeding apparatus from the switch back feeding path via the internal portion of the sheet feeding apparatus.

According to the invention, by forming the switch back feeding path on the upper position of the opened upper surface of the sheet feeding apparatus having the storage portion and the feeding path for the recording sheet to be supplied in the body apparatus, the recording sheet discharged into the switch back feeding path because of emergency stop of the body apparatus or the peripheral apparatus or the like can be made drop in the sheet feeding apparatus having configuration in which the internal portion of the sheet feeding apparatus is opened on the operation side and can be taken out on the operation side of the sheet feeding apparatus from the switch back feeding path via the internal portion of the sheet feeding apparatus.

In the invention, it is preferable that the supporting tray has a narrower width in an orthogonal direction to the feeding direction of the recording sheet than a width of the minimum recording sheet guided to the switch back feeding path.

According to the invention, the recording sheet is supported by the supporting tray in the switch back feeding path within a narrower area than the whole width in the orthogonal direction to the feeding direction. Consequently, the recording sheet discharged into the switch back feeding path because of emergency stop or the like of the body apparatus or the peripheral apparatus hangs downward from at least one side of the supporting tray in the orthogonal direction to the feeding direction and can be easily grasped by the operator's fingers via the internal portion of the apparatus located below the switch back feeding path.

According to the invention, by supporting the recording sheet by the supporting tray in the switch back feeding path within the narrower area than the whole width in the orthogonal direction to the feeding direction, the recording sheet discharged into the switch back feeding path because of emergency stop or the like of the body apparatus or the peripheral apparatus is made hang downward from at least one side of the supporting tray in the orthogonal direction to the feeding direction and is made be able to be easily grasped by the operator's fingers via the internal portion of the apparatus located below the switch back feeding path.

In the invention, it is preferable that the supporting tray has a wider supporting area in the orthogonal direction to the feeding direction of the recording sheet than a width of a feeding member of the recording sheet in the apparatus located below the switch back feeding path.

According to the invention, the upper portion of the recording sheet feeding member in the apparatus located below the switch back feeding path is covered by the supporting area of the supporting tray in the orthogonal direction to the feeding direction of the recording sheet. Consequently, the recording sheet discharged into the switch back feeding path because of emergency stop or the like of the body apparatus or the peripheral apparatus can be easily taken out from the switch back feeding path via the internal portion of the sheet feeding apparatus without any contact with the recording sheet feeding member in the apparatus located below the switch back feeding path.

According to the invention, by covering the upper part of the recording sheet feeding member in the apparatus located below the switch back feeding path by the supporting area of the supporting tray in the orthogonal direction to the feeding direction of the recording sheet, the recording sheet discharged into the switch back feeding path because of emergency stop or the like of the body apparatus or the peripheral apparatus can be easily taken out from the switch back feeding path via the internal portion of the sheet feeding apparatus without any contact with the recording sheet feeding member in the apparatus located below the switch back feeding path.

In the invention, it is preferable that the supporting tray is configured by wire rods.

According to the invention, the recording sheet fed to the switch back feeding path is supported by the wire rods. Consequently, the recording sheet discharged into the switch back feeding path because of emergency stop or the like of the body apparatus or the peripheral apparatus can be easily taken out from the supporting tray via the internal portion of the apparatus located below the switch back feeding path.

According to the invention, by supporting the recording sheet fed into the switch back feeding path by the wire rods, the recording sheet discharged into the switch back feeding path because of emergency stop or the like of the body apparatus or the peripheral apparatus can be easily taken out from the supporting tray via the internal portion of the apparatus located below the switch back feeding path. In addition, simplification of configuration of the supporting tray can realize reduction of costs and miniaturization of the apparatus.

In the invention, it is preferable that a holding member for holding a vertical position of the open end of the supporting tray is arranged on the apparatus located below the switch back feeding path.

According to the invention, the vertical position of the open end of the supporting tray cantilevered by the second peripheral apparatus are held by the holding member arranged on the apparatus located below the switch back feeding path. Consequently, there is no possibility that the open end of the supporting tray extending into the switch back feeding path will be displaced downward and damage or deformation will be caused in a part of the recording sheet fed into the switch back feeding path by contact with internal parts of the lower apparatus.

According to the invention, the vertical position of the open end of the supporting tray cantilevered by the second peripheral apparatus are held by the holding member arranged on the apparatus located below the switch back feeding path and thereby downward displacement of the open end of the supporting tray extending into the switch back feeding path can be prevented and damage or deformation can be prevented from being caused in a part of the recording sheet fed into the switch back feeding path by contact with the internal parts of the lower apparatus.

In the invention, it is preferable that the holding member supports the recording sheet fed into the switch back feeding path with the supporting tray.

According to the invention, the recording sheet fed into the switch back feeding path is supported by not only the supporting tray but the holding member for holding the vertical position of the open end of the supporting tray. Consequently, there can be reduction for the length requested for the supporting tray in the feeding direction of the recording sheet and there also can be reduction for the length of the supporting tray remaining in the switch back feeding path on the occasion of drawing out the supporting tray with the second peripheral apparatus. The recording sheet discharged into the switch back feeding path because of emergency stop or the like of the body apparatus or the peripheral apparatus can drop into the lower apparatus more easily.

According to the invention, the recording sheet fed into the switch back feeding path is supported by not only the supporting tray but the holding member for holding the vertical position of the open end of the supporting tray, and thereby there can be reduction for the length requested for the supporting tray in the feeding direction of the recording sheet, and there also can be reduction for the length of the supporting tray remaining in the switch back feeding path on the occasion of drawing out the supporting tray with the second peripheral apparatus. Therefore, the recording sheet discharged into the switch back feeding path because of emergency stop or the like of the body apparatus or the peripheral apparatus can be made drop into the lower apparatus more easily.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
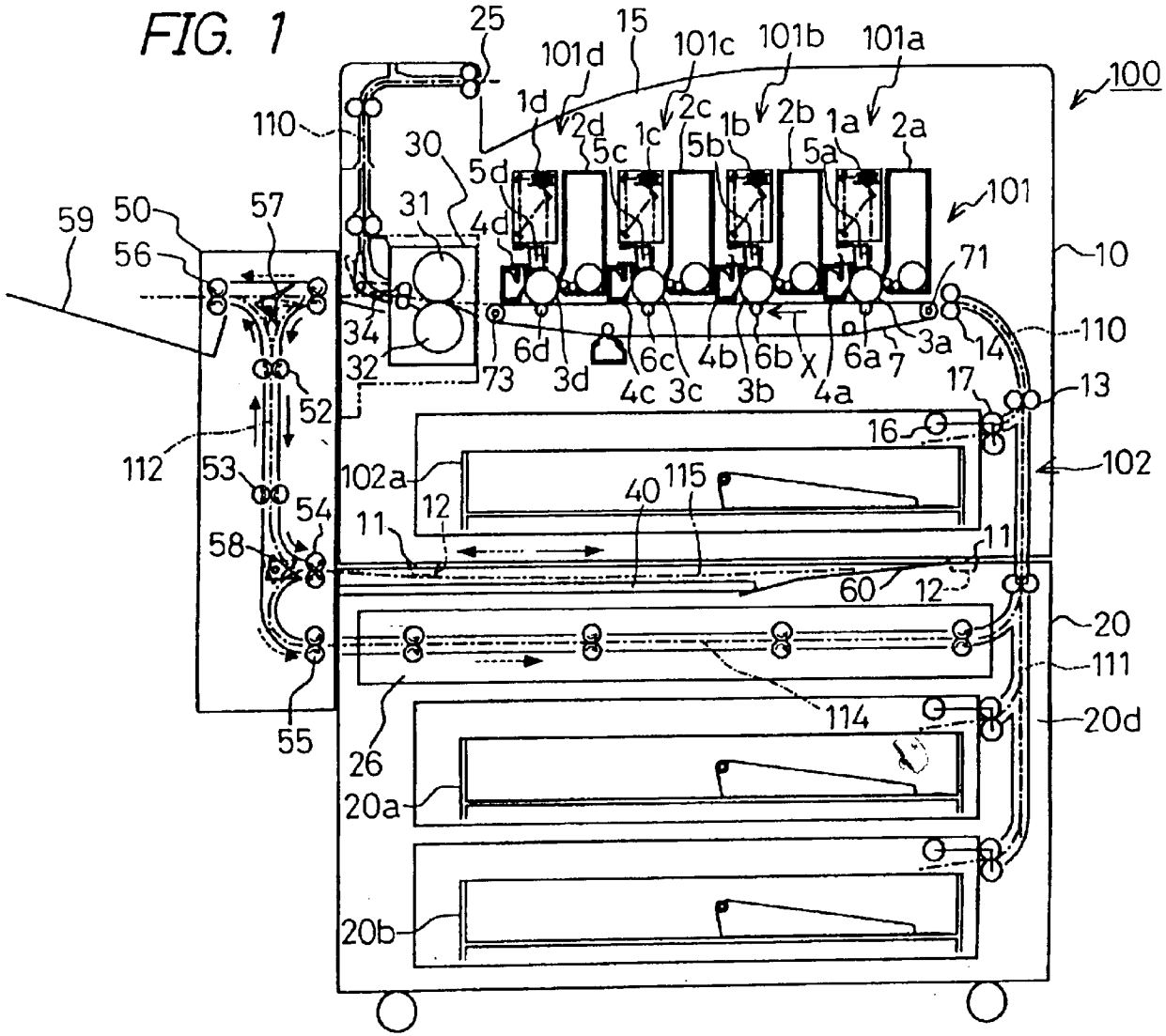
FIG. 1 is a view showing configuration of an image forming apparatus according to an embodiment of the invention.

Now referring to the drawings, preferred embodiments of the invention are described below.

FIG. 1 is a view showing configuration of an image forming apparatus according to an embodiment of the invention. An image forming apparatus 100 is configured by mounting a sheet feeding apparatus 20 as a first peripheral apparatus of the invention below a body apparatus 10 and mounting a relay feeding apparatus 50 as a second peripheral apparatus of the invention on one side of the body apparatus 10 (e.g. the left side of the body apparatus 10 in FIG. 1) and forms full color image, multicolor image or monochrome image on a surface or the both sides of the recording sheet (hereinafter referred to as "sheet") depending on image data provided externally.

Inside of the body apparatus 10 is provided with an image forming portion 101 including four image forming stations 101*a* to 101*d* and a sheet feeding portion 102 on which a sheet feeding cassette 102*a* storing a plurality of sheets is mounted. Each of image forming stations 101*a* to 101*d* corresponds to each of colors, i.e., black, cyan, magenta, and yellow respectively and these image forming stations are configured similarly each other. As an example, the image forming station 101*a* for forming black image is provided with a exposure unit 1*a*, a developing apparatus 2*a*, photoconductor drum 3*a*, a cleaner 4*a*, a charging apparatus 5*a*, and a transfer roller 6*a*. Other image forming stations 101*b* to 101*d* are similarly provided with exposure units 1*b* to 1*d*, developing apparatuses 2*b* to 2*d*, photoconductor drums 3*b* to 3*d*, cleaners 4*b* to 4*d*, charging apparatuses 5*b* to 5*d*, and transfer rollers 6*b* to 6*d* respectively.

An endless transfer feeding belt 7 is stretched on a driving pulley 73, a driven pulley 71 and the like via a gap between the photoconductor drums 3*a* to 3*d* and the transfer rollers 6*a* to 6*d* in each image forming station 101*a* to 101*d* respectively below the image forming stations 101*a* to 101*d*. The transfer feeding belt 7 rotates in a direction of arrow X by rotation of the driving pulley 73 and sequentially feeds the sheet which is electrostatically absorbed on an outside surface of the transfer feeding belt 7 rotating via the gap between the photoconductor drums 3*a* to 3*d* and the transfer rollers 6*a* to 6*d* to the image forming stations 101*a* to 101*d*.

When full color image is formed, electric charge with predetermined polarity is equally applied on the surface of the photoconductor drum 3*a* in the image forming station 101*a* by the charging apparatus 5*a* and then an electrostatic latent image is formed by exposure of image light based on black image data given from an exposure unit 1*a*. The electrostatic latent image formed on the surface of the photoconductor drum 3*a* is developed to a toner image by a black toner supplied from the developing apparatus 2*a* and this toner image is transferred on an upper surface of the sheet fed by the transfer feeding belt 7 via the transfer roller 6*a*. As to the surface of the photoconductor drum 3*a* after the toner image is transferred on the sheet, the remaining toner on the surface of the photoconductor drum 3*a* is removed by a cleaner 4*a* and the surface of the photoconductor drum 3*a* is repeatedly used for a process consisting of charging, exposure, development and transfer.

In the image forming stations 101*b* to 101*d*, cyan, magenta and yellow toner images are formed on the surfaces of the photoconductor drums 3*b* to 3*d*. While the sheet which is electrostatically absorbed on the outside surface of the transfer feeding belt 7 passes the image forming stations 101*b* to 101*d*, cyan, magenta and yellow toner images are sequentially transferred on the upper surface of the sheet and the full color image is formed.

When the multicolor image or the monochrome image is formed, the toner image is formed only on an image forming station corresponding to image color for which image data exist from among the image forming stations 101*b* to 101*d*.

The body apparatus 10 is provided with a fixing apparatus 30 including a heating roller 31 and a pressure roller 32. The sheet which passed the image forming portion 101 and on which the toner image was transferred is guided by the fixing apparatus 30 and receives heat and pressure. By heat and pressure, the toner image transferred on the sheet is pressed under condition of molten toner image and is solidly fixed on the surface of the sheet.

In the body apparatus 10, a sheet feeding path 110 is formed from the feeding cassette 102*a* of the feeding portion 102 up to a sheet discharging tray 15 formed on the upper side of the body apparatus 10 via the image forming portion 101 and the fixing apparatus 30. In the sheet feeding path 110, feeding means such as a pick up roller 16, a sheet feeding roller 17, a resist roller 14, a flapper 34 and a sheet discharging roller 25 are arranged.

The feeding portion 102 feeds the sheet stored in the feeding cassette 102*a* one by one into the sheet feeding path 110 by the pick up roller 16 and the sheet feeding roller 17. The sheet fed into the sheet feeding path 110 is guided by the resist roller 14 to the transfer feeding belt 7 at the timing synchronized with rotation of the photoconductor drums 3*a* to 3*d* in each image forming station 101*a* to 101*d* in the image forming portion 101, in other words at the timing at which a leading end of the sheet coincides with a leading end of the toner image carried and supported by the photoconductor drums 3*a* to 3*d* on a position of pressure contact of the photoconductor drums 3*a* to 3*d* with the transfer rollers 6*a* to 6*d* under condition under which the transfer feeding belt 7 is put between the photoconductor drums 3*a* to 3*d* and the transfer rollers 6*a* to 6*d*.

The flapper 34 selectively guides the sheet which passed the fixing apparatus 30 to the sheet discharging tray 15 or the relay feeding apparatus 50. When the flapper 34 is under condition shown by solid line in FIG. 1, the sheet which passed the fixing apparatus 30 is guided to the sheet discharging tray 15 and is discharged onto the sheet discharging tray 15 under condition of the image forming surface put facedown by rotation of the discharging roller 25.

The sheet feeding apparatus 20 which is the first peripheral apparatus in the invention is provided with a sheet feeding cassette 20*a*, a sheet feeding cassette 20*b* and an intermediate tray 26 as three-tier sheet feeding apparatus up and down and is arranged below the body apparatus 10 and the body apparatus 10 is placed on an upper surface of the sheet feeding apparatus 20. In other words, the sheet feeding apparatus 20 is mounted vertically for the body apparatus 10. In the sheet feeding apparatus 20, a sheet sub-feeding path 111 is formed so as to make the sheet feeding cassettes 20*a* and 20*b* and an intermediate tray 26 communicate with a sheet feeding path 110 in the body apparatus 10. The sheet feeding cassette 20*a* and the sheet feeding cassette 20*b* store a plurality of sheets respectively. The intermediate tray 26 configures an intermediate feeding path 114 which communicates an after-mentioned relay feeding apparatus 112 with the sheet sub-feeding path 111. In addition, a gap between the body apparatus 10 and the sheet feeding apparatus 20 is used as a switch back feeding path 115 to which the sheet whose the leading and rear ends should be reversed is guided.

The upper surface of the sheet feeding apparatus 20 facing the body apparatus 10 is opened. In other words, the sheet feeding apparatus 20 is provided with a housing 20*d* for storing the sheet feeding cassettes 20*a*, 20*b* and the intermediate tray 26, and the opening through which an outside of the housing 20*d* is communicated with an inside of the housing 20*d* and in which the sheet can be freely inserted in an area of the housing 20*d* facing the body apparatus, is formed.

The sheet feeding cassettes 20*a* and 20*b* and the intermediate tray 26 are mounted on an inside of the sheet feeding apparatus from the front side for operating the sheet feeding apparatus 20 (corresponding to the front side in FIG. 1) and can be drawn out to the front side of the sheet feeding apparatus 20. The sheet feeding cassette 20*a* and the sheet feeding cassette 20*b* are made in consideration of easiness of work for storing the sheet and the intermediate tray 26 is made in consideration of a case where the intermediate tray 26 is replaced with a sheet feeding cassette and also in consideration of easiness of work for removing the sheet stopped in the intermediate tray 26.

The sheet feeding cassette 20*a* and the sheet feeding cassette 20*b* can store sheets having different paper quality and size each other. In other words, paper quality or size of the sheet stored in the feeding cassette 20*a* may be different from paper quality or size of the sheet stored in the feeding cassette 20*b* respectively. However, configurations of these sheet feeding cassettes 20*a* and 20*b* are not essential for the sheet feeding apparatus 20. That is, it is sufficient for the sheet feeding apparatus 20 configuring the image forming apparatus 100 related to the embodiment of the invention to be at least designed so that the intermediate tray or the sheet feeding cassette can be mounted on the position of the intermediate tray 26 and it is not required for the sheet feeding apparatus 20 to be designed so that the intermediate tray or the sheet feeding cassettes can be mounted on the position of the intermediate tray 26 under condition of three tiers. Consequently, the sheet feeding apparatus configuring optional number of tiers can be used depending on condition under which the sheet feeding apparatus is used.

Figure 5:
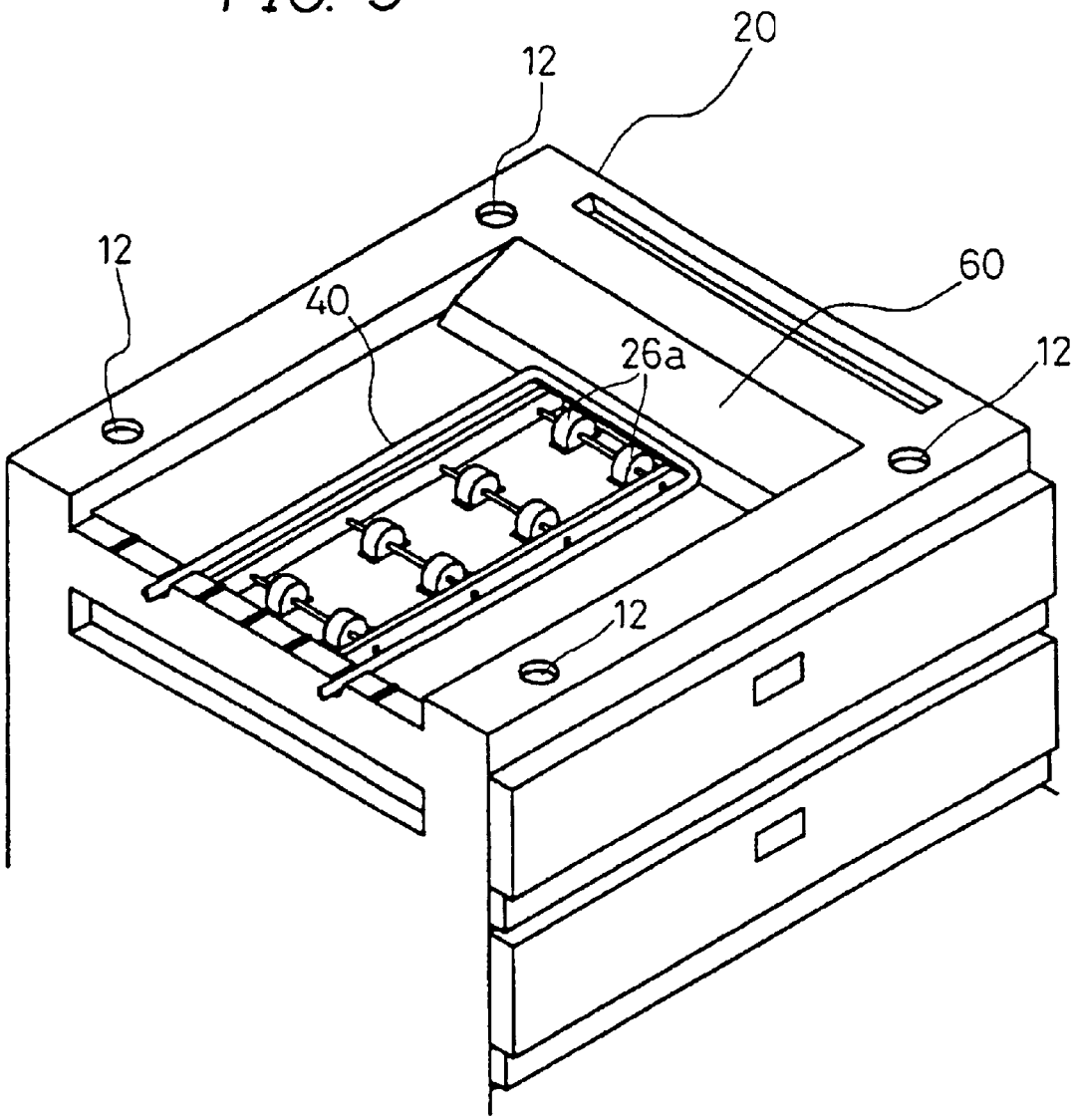
FIG. 5 is a perspective view of the switch back feeding path in the image forming apparatus.

As shown in after-mentioned FIG. 5, on the upper surface of the sheet feeding apparatus 20, a concave portion 12 into which an insulator 11 is fitted is formed on a position facing the insulator 11 projecting from the bottom surface of the body apparatus 10. Since the insulator 11 is fitted into the concave portion 12, a horizontal position of the body apparatus 10 is determined on the occasion of placing the body apparatus 10 on the upper surface of the sheet feeding apparatus 20 and a narrow gap is vertically formed between the bottom surface of the body apparatus 10 and the upper surface of the sheet feeding apparatus 20.

In the inside of the relay feeding apparatus 50 as the second peripheral apparatus, a relay feeding path 112 on which feeding rollers 51 to 55, a sheet discharging roller 56 and flappers 57 and 58 are arranged, is formed. The relay feeding apparatus 50 is horizontally mounted on the body apparatus 10. The relay feeding path 112 communicates an exit side of the fixing apparatus 30 in the body apparatus 10 with the intermediate feeding path 114 and the switch back feeding path 115. A sheet discharging tray 59 is mounted on the relay feeding apparatus 50. The sheet which passed the fixing apparatus 30 in the body apparatus 10 can be discharged under condition of the image forming surface put faceup onto the sheet discharging tray 59 via the flappers 34 and 57 under condition shown by broken line in FIG. 1

In addition, feeding rollers 52 to 54 arranged in the relay feeding apparatus 50 are designed so as to be capable of being rotated in both normal and reverse directions. When the sheet which passed the fixing apparatus 30 in the body apparatus 10 is discharged onto the sheet discharging tray 59 under facedown condition, the flappers 57 and 58 are positioned under condition shown by solid line in FIG. 1 to guide the sheet into the relay feeding path 11 and the feeding rollers 52 to 54 under condition of holding the sheet therebetween are rotated reversely to reverse the sheet.

At the time of forming images on the both sides of the sheet, the sheet which was fed from one of the feeding cassettes 102*a*, 20*a* and 20*b* and whose one side was subject to image forming during passing the image forming portion 101 and the fixing apparatus 30 in the body apparatus 10, is guided to the switch back feeding path 115 from the relay feeding path 112 by the flappers 57 and 58 under condition shown by solid line in FIG. 1 and rotation of the feeding roller 54 is stopped with holding a part of the sheet. Thereafter, the flapper 58 is positioned under condition shown by broken line in FIG. 1 and the feeding roller 54 is rotated reversely and the sheet whose leading and rear ends in the feeding direction are reversed is guided to the intermediate feeding path 114, and the sheet is guided to the image forming portion 101 via the sheet sub-feeding path 111 and the sheet feeding path 110 at a predetermined timing. At that time, the sheet are reversed and a second surface of the sheet is faced to each of the photoconductor drums 3*a* to 3*d* of each of image forming stations 101*a* to 101*d*.

The sheet having both sides on which images are formed is discharged onto the sheet discharging tray 15 or the sheet discharging tray 59 depending on condition of the flapper 34 and the flapper 57. When a plurality of sheets having both sides on which images are formed is discharged onto the discharging tray 59, the sheet are appropriately reversed by selectively using the flapper 58 and the feeding rollers 52 to 54 according to the order of inputting each page of the image data into the body apparatus and there can be occurrence of condition under which the order of the pages of the image is adjusted concerning a plurality of the sheets having both sides on which images are formed. The flapper 58 and the feeding roller 54 correspond to the switch back mechanism of the invention.

Figure 6A:
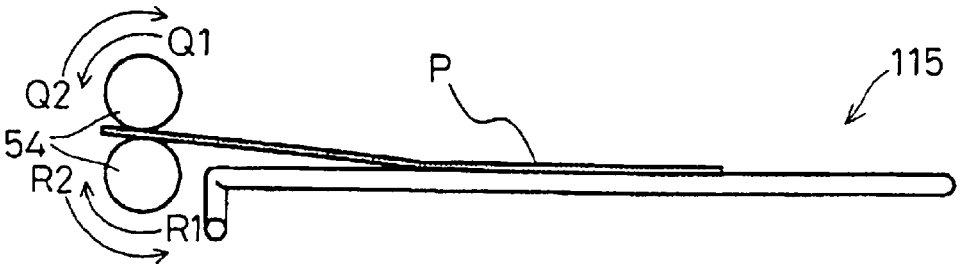
FIGS. 6A and 6B are views illustrating conditions of the feeding sheet in the switch back feeding path at the times of normal operation and emergency stop.

When the leading and rear ends of the sheet in the feeding direction are reversed by using the switch back feeding path 115, the feeding roller 54 is composed of a pair of vertical rollers is normally rotated in arrow directions Q1 and R1 and a sheet P is fed into the switch back feeding path 115 as shown in FIG. 6A under condition where supplying the power to the image forming apparatus 100 is normally continued. And then, the feeding roller 54 is reversely rotated in arrow directions Q2 and R2 under condition where the feeding roller 54 holds the rear end of the sheet P in the feeding direction and the sheet P is fed out from the switch back feeding path 115 under condition where the leading and rear ends of the sheet P are reversed in the feeding direction.

A supporting tray 40 cantilevered by the relay feeding apparatus 50 extends into the switch back feeding path 115 formed between the bottom surface of the body apparatus 10 and the upper surface of the sheet feeding apparatus 20. A holding member 60 extends from the opposite side to a side on which the relay feeding apparatus 50 is mounted, on the upper part in the sheet feeding apparatus 20. A vertical position of open end of the supporting tray 40 is determined by abutting on the holding member 60 from above. The sheet guided into the switch back feeding path 115 via the flapper 58 and the feeding rollers 54 is supported by abutting on upper surfaces of the supporting tray 40 and the holding member 60.

A post-processing apparatus not shown can be mounted on the left side of the relay feeding apparatus 50 in FIG. 1. The post-processing apparatus is provided with at least one mechanism selected from the group consisting of a sorting mechanism for collating processing of a plurality of sheets on which images are formed, a punching mechanism for punching the sheets and a stapling mechanism for stapling a plurality of sheets.

Figure 2:
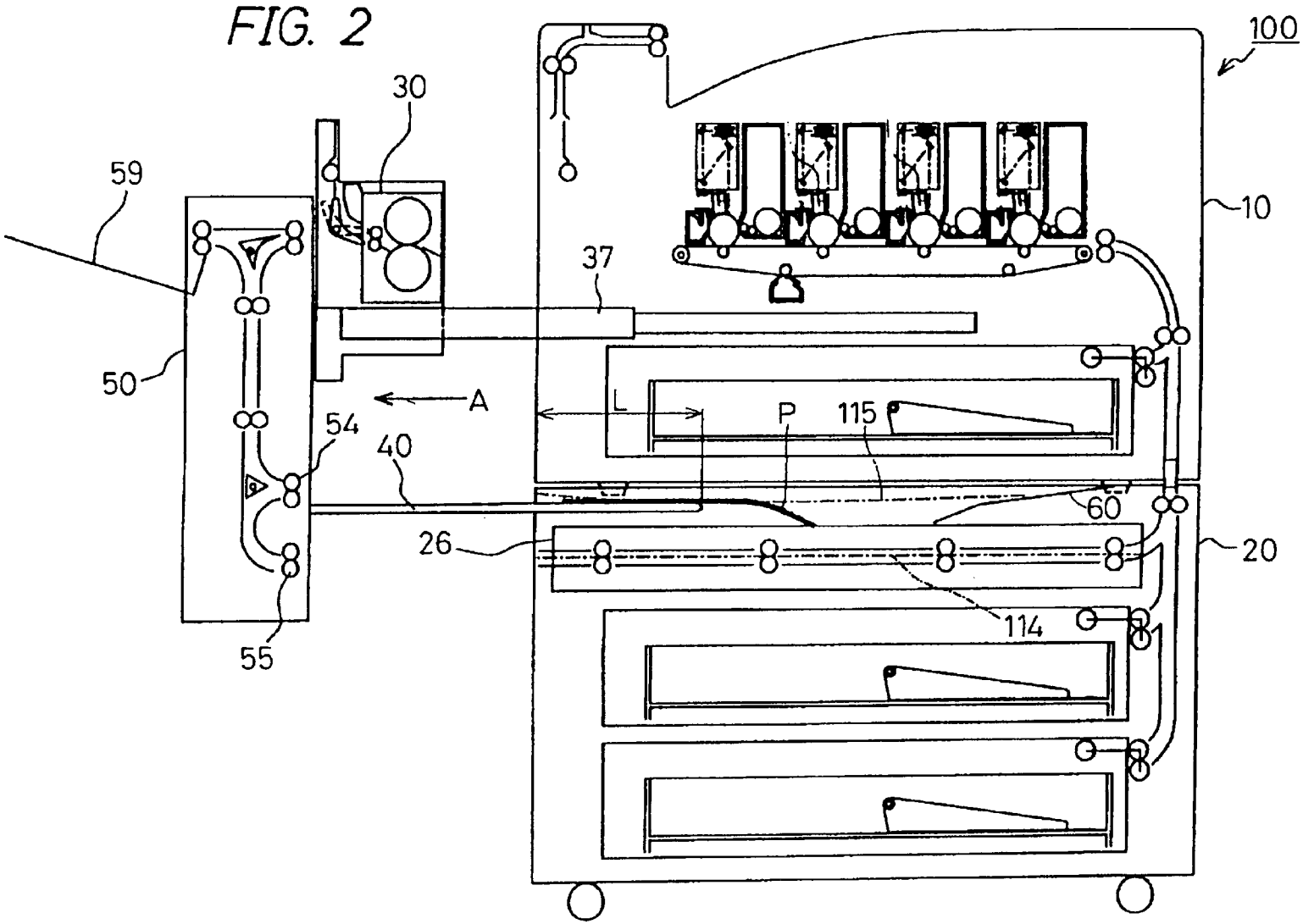
FIG. 2 is a view showing condition under which a relay feeding apparatus is separated from the body apparatus in the image forming apparatus.

FIG. 2 is a view showing condition under which the relay feeding apparatus is separated from the body apparatus in the image forming apparatus. When the body apparatus 10, the sheet feeding apparatus 20 or the relay feeding apparatus 50 is brought to emergency stop and the power source is shut down because of malfunction of the control system or the recording sheet feeding jam caused by any trouble in the image forming apparatus 100, as to most of members which were driven in these apparatuses at the time of supplying the power force, supply of driving force is stopped without receiving operation of braking force and driving operation of the members is continued by inertia force. Therefore, when the power source for the relay feeding apparatus 50 is shut down during operation of normal rotation of the feeding roller 54 configuring the switch back mechanism for guiding the sheet into the switch back feeding path 115, the normal rotation of the feeding roller 54 is continued by the inertia force and a rotating speed of the feeding roller 54 is gradually reduced because of not only stop of supplying the driving force but also no operation of the braking force.

Figure 6B:
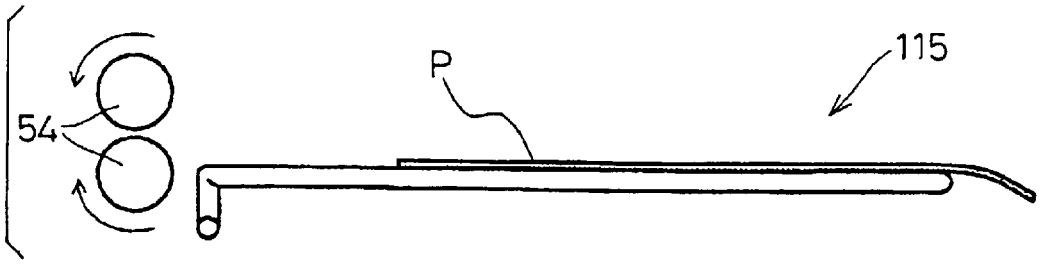

Thus, when the power source for the relay feeding apparatus 50 is shut down during operation of normal rotation of the feeding roller 54 to be performed for guiding the sheet into the switch back feeding path 115 as mentioned above, the rotation of the feeding roller 54 cannot be controlled so as to be once stopped with holding a part of the sheet and there is a case where the rear end of the sheet P in the feeding direction passes the feeding roller 54 and the sheet P is discharged into the switch back feeding path 115 as shown in FIG. 6B. When the sheet P has been discharged into the switch back feeding path 115, the sheet P cannot be fed from the switch back feeding path 115 by reverse rotation of the feeding roller 54.

Consequently, the image forming apparatus 100 according to the embodiment of the invention is configured so that the upper surface of the sheet feeding apparatus 20 located below the switch back feeding path 115 is opened to collect the sheet discharged into the switch back feeding path 115 via the inside of the sheet feeding apparatus 20 from the front side of the sheet feeding apparatus 20.

In the image forming apparatus 100, the relay feeding apparatus 50 is mounted on the left side of the body apparatus 20 via a guide rail 37 so as to be freely drawn out. When the relay feeding apparatus 50 is drawn out in an arrow direction A (the left direction) shown in FIG. 2 from the body apparatus 20, the supporting tray 40 cantilevered by the relay feeding apparatus 50 is also drawn out in the arrow direction A from the switch back feeding path 115. This prevents the open end of the supporting tray 40 from abutting on the holding member 60 arranged in the sheet feeding apparatus 20 and enables a lower surface of the switch back feeding path 115 to be opened to the inside of the sheet feeding apparatus 20 on a position between the open end of the supporting tray 40 and the holding member 60.

When the lower surface of the switch back feeding path 115 is opened to the inside of the sheet feeding apparatus 20 on a position between the open end of the supporting tray 40 and the holding member 60 as mentioned above, one end side of the sheet P discharged into the switch back feeding path 115 is not supported by the supporting tray 40 and the holding member 60 and hangs into the inside of the sheet feeding apparatus 20. When the intermediate tray 26 is pulled out on the front side of the sheet feeding apparatus 20 in this condition, the sheet P discharged into the switch back feeding path 115 can be grasped by the operator's fingers inserted in the space in which the intermediate tray 26 was mounted and the sheet P can be drawn out on the front side of the sheet feeding apparatus 20 and can be collected.

A portion having length L from the open end of the supporting tray 40 remains in the switch back feeding path 115 under condition where the relay feeding apparatus 50 is drawn out up to a maximum position in the arrow A direction for the body apparatus 10. Since the open end of the supporting tray 40 is never exposed on the outside of the switch back feeding path 115 in spite of drawing out the relay feeding apparatus 50 as mentioned above, there is no need for guiding the open end of the supporting tray 40 into the switch back feeding path 115 on the occasion of pushing the relay feeding apparatus 50 to the side of the body apparatus 10 again.

By shortening this length L than length (139.7 mm as an invoice size) of the minimum-size sheet to be guided into the switch back feeding path 115 as an object for double-side image forming processing, one end sides of all the sheets discharged into the switch back feeding path 115 can be made hung in the inside of the sheet feeding apparatus 20 and the sheets can be easily grasped by the operator's fingers inserted in the sheet feeding apparatus 20 from the front side of the sheet feeding apparatus 20. In addition, when the length L is less than one-half of length of the sheet P discharged into the switch back feeding path 115 in the feeding direction, there is a high possibility that the sheet P will completely drop into the sheet feeding apparatus 20 from the switch back feeding path 115. In this case, the sheet P is present on the intermediate tray 26 drawn out to the front side of the sheet feeding apparatus 20 and collection of the sheet P will become easier. In consideration of this easier collecting the sheet P, the length L may be less than one-half of length in the feeding direction of minimum-size sheet to be guided into the switch back feeding path 115.

Figure 3:
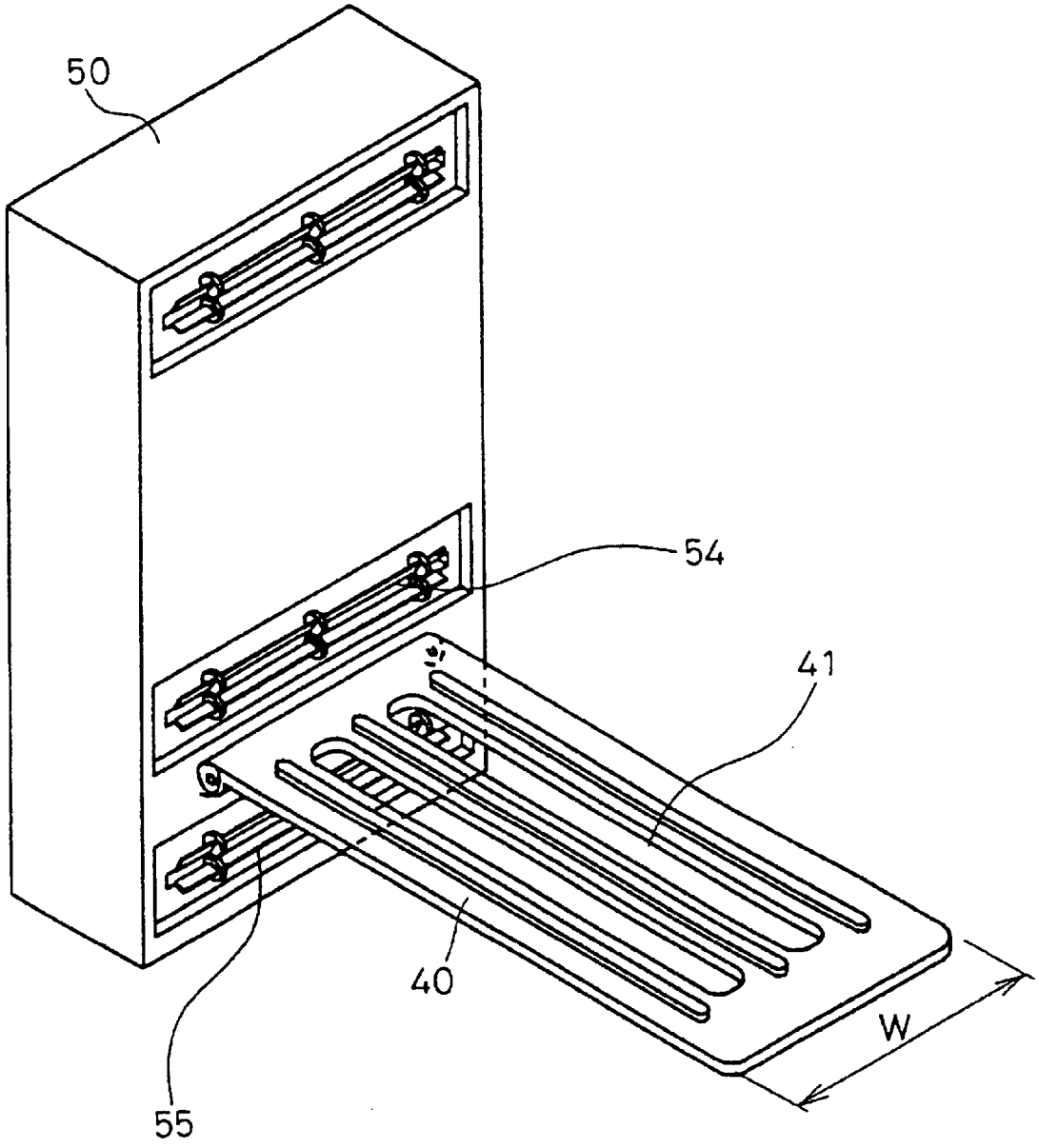
FIG. 3 is a perspective view showing condition under which the supporting tray is attached to the relay feeding apparatus mounted on the body apparatus in the image forming apparatus.

FIG. 3 is a perspective view showing condition under which the supporting tray is attached to the relay feeding apparatus mounted on the body apparatus in the image forming apparatus. The supporting tray 40 extending into the switch back feeding path 115 is formed in substantially plate-like shape and is cantilevered between the feeding rollers 54 and 55 which are exposed on the side of the relay feeding apparatus 50 on the side of the body apparatus 10. A hole portion 41 is formed on the supporting tray 40. As shown in FIG. 2, when the relay feeding apparatus 50 is drawn out from the body apparatus 10, a feeding entrance of the intermediate tray 26 of the sheet feeding apparatus 20 is visible from a position above the supporting tray 40 via the hole portion 41 of the supporting tray 40. Visibility of the feeding entrance of the intermediate tray 26 can be also secured by configuring the supporting tray 40 by transparent material or an after-mentioned wire rod.

A width W of the supporting tray 40 in a direction orthogonal to the sheet feeding direction is shorten in comparison with a width of the minimum-size sheet to be fed into the switch back feeding path 115 as an object for double-side image forming processing. A part of the sheet discharged into the switch back feeding path 115 hangs from at least one side of the direction orthogonal to the sheet feeding direction on the supporting tray 40 into the sheet feeding apparatus 20 located below the supporting tray 40 and operation of grasping a part of the sheet discharged into the switch back feeding path 115 by the operator's fingers inserted in the space in which the intermediate tray 26 was mounted and operation of collecting the sheet becomes easy. In this case, collecting the sheet becomes easier by preventing a part of the sheet from abutting on the supporting tray 40 at least on the front side in the direction orthogonal to the sheet feeding direction.

Figure 4:
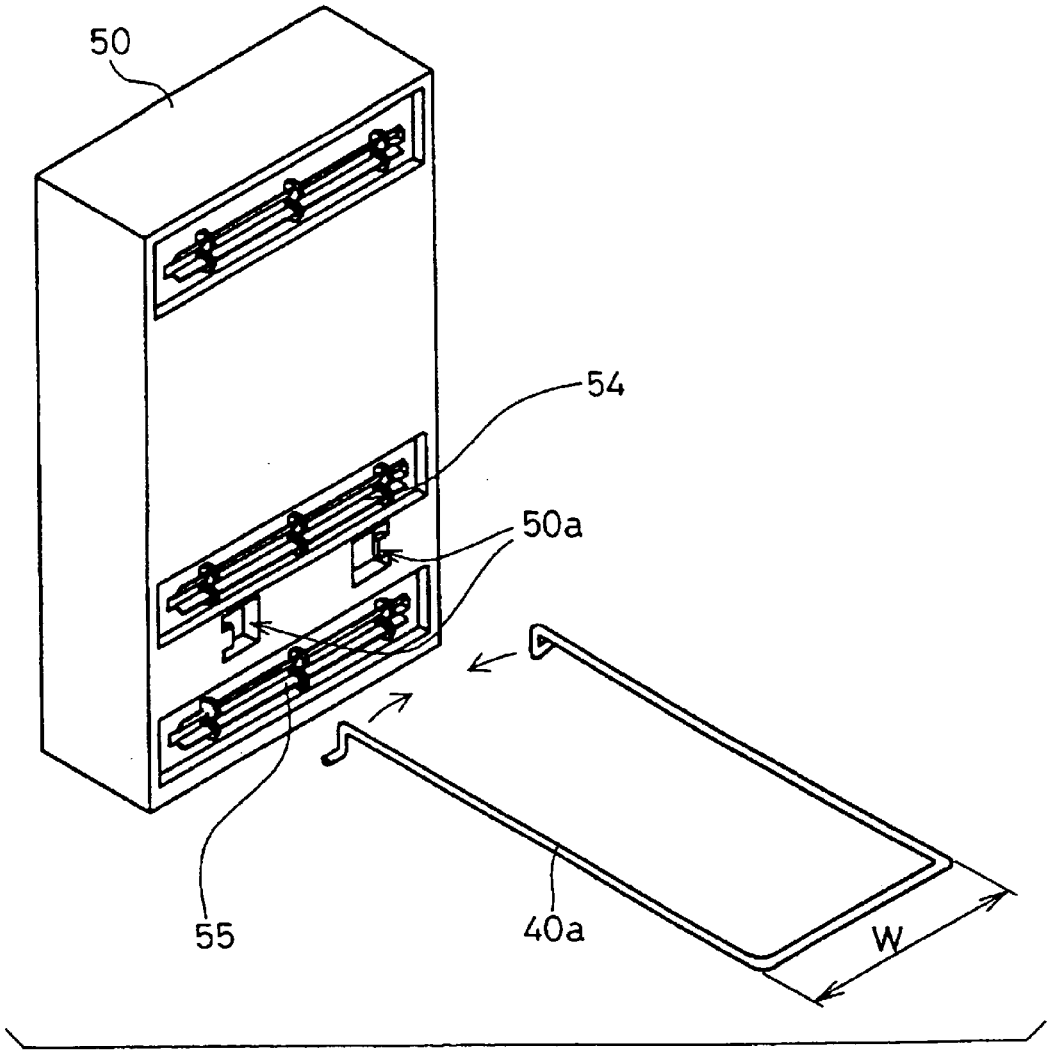
FIG. 4 is a perspective view showing condition under which another supporting tray is attached to the relay feeding apparatus mounted on the body apparatus in the image forming apparatus.

FIG. 4 is a perspective view showing condition under which another supporting tray is attached to the relay feeding apparatus mounted on the body apparatus in the image forming apparatus. According to an example shown in FIG. 4, a supporting tray 40*a* is configured by a metal wire rod folded in substantially U shape, such as stainless steel having an external diameter of approximately 3 to 5 mm. The supporting tray 40*a* can be easily formed by using the wire rod and can be easily attached to an attaching portion 50*a* formed on the relay feeding apparatus 50 because of elastic force of the supporting tray 40*a*.

As to the supporting tray 40*a* formed by the wire rod, it is difficult to determine a vertical position of the open end of the supporting tray 40*a* because of low precision of dimension or an angle. When the open end of the supporting tray 40*a* is displaced downward, there is a possibility that the end of the sheet guided into the switch back feeding path 115 will abut on the feeding roller or the like in the intermediate tray 26 arranged in the sheet feeding apparatus 20 located downward and breakage and deformation or the like of the sheet will be caused. However, as to the above-mentioned image forming apparatus 100, since the sheet feeding apparatus 20 is provided with the holding member 60 which the open end of the supporting tray 40*a* abut on from above the holding member 60, the vertical position of the open end of the supporting tray 40*a* is certainly determined and there is no possibility that breakage and deformation or the like of the sheet guided into the switch back feeding path 115 will be caused. In addition, since the bottom surface of the switch back feeding path 115 is continuously formed by the supporting tray 40 (40*a*) and the holding member 60, the leading and rear ends of a large scale sheet such as A3 size, leisure size or the like in the direction of feeding the sheet can be also smoothly reversed in the switch back feeding path 115.

FIG. 5 is a perspective view of the switch back feeding path in the image forming apparatus. As to the switch back feeding path 115 on which the leading and rear ends in the feeding direction of the sheet becoming an object for double-side image forming processing are reversed, the switch back feeding path 115 is configured by the supporting tray 40 and the holding member 60 in the gap between the opened upper surface of the sheet feeding apparatus 20 and the bottom surface of the body apparatus 10 to be placed on the upper surface of the sheet feeding apparatus 20. The width W of the supporting tray 40 in the direction orthogonal to the sheet feeding direction should be determined in consideration of the minimum size of the sheet guided into the switch back feeding path 115 as mentioned above, but the width of the sheet feeding member of the intermediate tray 26 should be also considered.

In other words, width W of the supporting tray 40 in the direction orthogonal to the sheet feeding direction is made wider than the width of a feeding roller 26*a* which is a sheet feeding member and arranged in the intermediate tray 26 in the sheet feeding apparatus 20 located below the switch back feeding path 115. In the direction orthogonal to the sheet feeding direction, an area above the feeding roller 26*a* in the intermediate tray 26 located below the switch back feeding path 115 is covered by supporting area of the supporting tray 40. The sheet discharged into the switch back feeding path 115 is never in contact with the feeding roller 26*a* arranged in the intermediate tray 26 located below the switch back feeding path 115.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a body apparatus for performing an image forming processing for a recording sheet; and a peripheral apparatus to be mounted at least on a position above or below the body apparatus, a gap being formed as a switch back feeding path between the body apparatus and the peripheral apparatus, leading and rear ends of the recording sheet in a feeding direction being reversed in the switch back feeding path, wherein an upper surface of the body apparatus or the peripheral apparatus located on a lower position is opened, and the peripheral apparatus mounted on a position above or below the body apparatus is arranged below the body apparatus and is a sheet feeding apparatus having a storage portion and a feeding path for the recording sheet to be supplied in the body apparatus.

2. The image forming apparatus of claim 1, wherein a holding member for holding a vertical position of the open end of the supporting tray is arranged on the apparatus located below the switch back feeding path.

3. The image forming apparatus of claim 2, wherein the holding member supports the recording sheet fed into the switch back feeding path with the supporting tray.

4. The image forming apparatus of claim 1, wherein the peripheral apparatus to be mounted on a position above or below the body apparatus includes a housing, and wherein an opening through which an outside of the housing is communicated with an inside of the housing and in which the recording sheet can be freely inserted, is formed in an area of the housing facing the body apparatus.

5. An image forming apparatus comprising:

a body apparatus for performing an image forming processing for a recording sheet; and a peripheral apparatus to be mounted at least on a position above or below the body apparatus, a gap being formed as a switch back feeding path between the body apparatus and the peripheral apparatus, leading and rear ends of the recording sheet in a feeding direction being reversed in the switch back feeding path, wherein an upper surface of the body apparatus or the peripheral apparatus located on a lower position is opened, and the peripheral apparatus includes: a first peripheral apparatus mounted on a position above or below the body apparatus; and a second peripheral apparatus mounted on the body apparatus in the horizontal direction, having the switch back mechanism for reversing the leading and rear ends of the recording sheet in the feeding direction, and wherein the second peripheral apparatus is provided with a supporting tray extending into the switch back feeding path, for supporting the recording sheet, and the supporting tray is drawn out in the horizontal direction from the body apparatus with the second peripheral apparatus up to a position on which extension length of the supporting tray becomes shorter than the length in the feeding direction of the minimum recording sheet guided to the switch back feeding path.

6. The image forming apparatus of claim 5, wherein the supporting tray has a narrower width in an orthogonal direction to the feeding direction of the recording sheet than a width of the minimum recording sheet guided to the switch back feeding path.

7. The image forming apparatus of claim 5, wherein the supporting tray has a wider supporting area in the orthogonal direction to the feeding direction of the recording sheet than a width of a feeding member of the recording sheet in the apparatus located below the switch back feeding path.

8. The image forming apparatus of claim 5, wherein the supporting tray is configured by wire rods.

* * * * *